United States Patent [19]

Hupkes

[11] 4,018,349

[45] Apr. 19, 1977

[54] TRANSHIPMENT INSTALLATION, PARTICULARLY FOR CONTAINERS

[75] Inventor: Leonard Hupkes, Heemstede, Netherlands

[73] Assignee: Conrad-Stork B.V.

[22] Filed: Sept. 2, 1975

[21] Appl. No.: 609,359

[30] Foreign Application Priority Data

Sept. 6, 1974 Netherlands ..... 7411880

[52] U.S. Cl. ..... 214/87; 214/14; 212/14; 212/15

[51] Int. Cl.[2] ..... B63B 27/12

[58] Field of Search ..... 214/14 R, 87, 88, 518; 198/183, 126, 189, 195; 212/14, 15, 16

[56] References Cited

UNITED STATES PATENTS

| | | | |
|---|---|---|---|
| 1,891,687 | 12/1932 | Norman | 198/126 |
| 2,789,686 | 4/1957 | Bonnafe | 198/189 |
| 3,812,987 | 5/1974 | Watatani | 214/14 X |
| 3,894,627 | 7/1975 | Jabbush et al. | 198/183 X |

FOREIGN PATENTS OR APPLICATIONS

| | | | |
|---|---|---|---|
| 825,230 | 12/1951 | Germany | 214/14 |

*Primary Examiner*—Albert J. Makay
*Attorney, Agent, or Firm*—Arnold, White & Durkee

[57] ABSTRACT

A container loading and unloading device is described wherein containers are raised along a substantially vertical path, thereafter displaced along a horizontal path and finally lowered along a vertical path. The device comprises at least one horizontal girder supported by a frame; at least two hoists disposed for raising and lowering of the containers, the hoists being supported by and movable over the girder and operatively positioned a distance from each other; and at least one substantially horizontally extending continuous conveyor for the horizontal displacement of the containers. Such conveyor is situated between the hoists and includes a support for at least one container and means for displacing such support and container placed thereon along a horizontal path from a point near one hoist to a point near the other.

5 Claims, 2 Drawing Figures

TRANSHIPMENT INSTALLATION, PARTICULARLY FOR CONTAINERS

Figure 1:
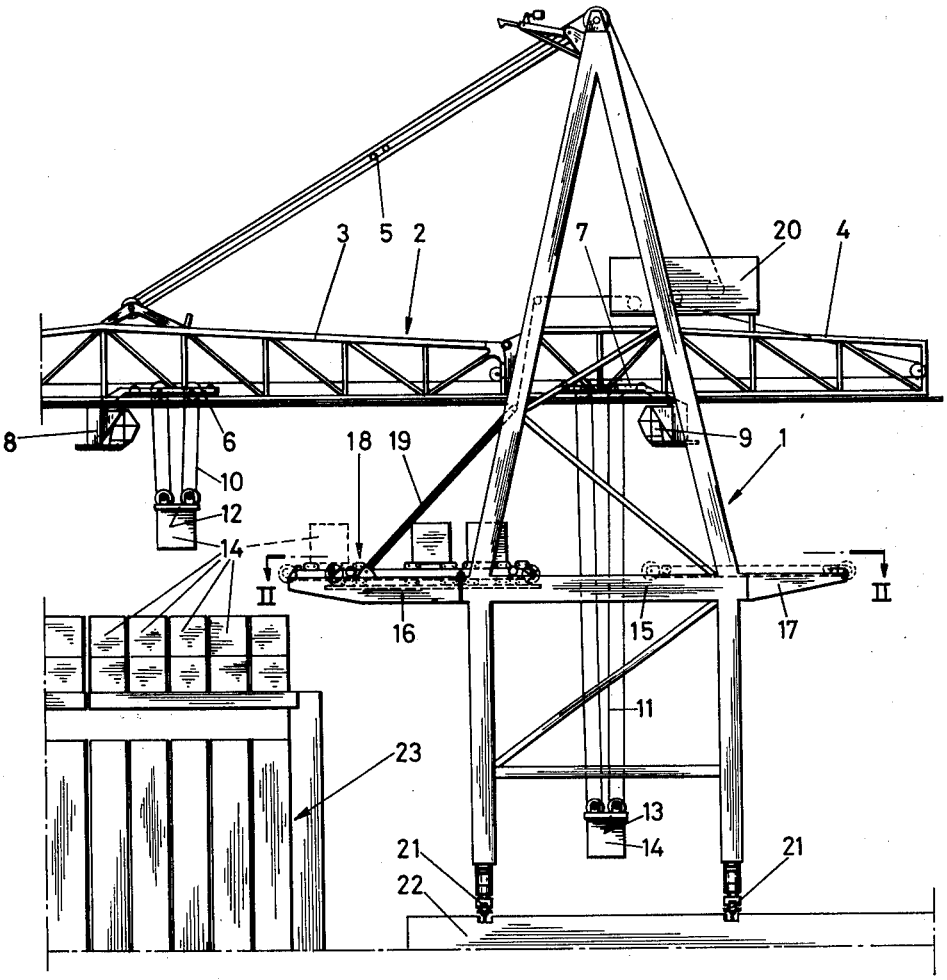

The invention relates to a transhipment installation, particularly for containers, in which a container is substantially lifted along a vertical path, thereupon displaced along a horizontal path and finally lowered again along a vertical path, which installation comprises at least one horizontal girder supported by a frame at a certain elevation above the ground; at least two hoisting devices mainly serving for the vertical transport, supported by and movable over the girder and disposed at a distance from each other in the operative position; and at least one device for the horizontal transport, situated between the said hoisting devices and near the girder, which device comprises a support for at least one container and means for displacing said support and a container placed thereon along a horizontal path from a point near one of said hoisting device to a point near the other hoisting device. Such a transhipment installation is known from the Dutch Patent Application No. 70.01737 (corresponds to U.S. Pat. No. 3,630,390).

With a transhipment installation of this type, the overall transport path passed by the container is divided into three sections, two vertical paths and one horizontal, while a separate transport device is present for each of these paths. In this way, the transhipment capacity is increased considerably with respect to the generally known transhipment arrangements, in which the overall transport path is handled by one transport device only, due to the fact that shorter transport cycles are realised for the various transport paths.

In the aforesaid known installation, the device for the horizontal transport consists of a pallet, movable along the girder, upon which pallet one container can be placed by means of one of the hoisting devices, upon which this pallet is moved to the other hoisting device, where this hoisting device lifts the container from the pallet and lowers it, after which the empty pallet is again moved to the first hoisting device.

This known device has the disadvantage that, in order to realise a good continuous operation, the three transport devices should be operated in perfect timed relationship with each other as otherwise waiting times may occur. Often, this mutual timing will be unrealisable in practice. For instance, during the unloading of a container ship, the one device for the vertical transport which is positioned above a transport system present on the quay side, such as a railway- or truck transport system, and which is conveying the containers taken from the pallet of the horizontal transport device to this transport system, will often suffer a delay owing to, for instance, an empty truck having to be driven up, while the other device for the vertical transport which is positioned above the ship, and by means of which the containers are lifted from this ship, could carry on but, in case of such slowing down in the operation of the one device for the vertical transport, will have to wait until the device for the horizontal transport, which already has received a container, will have transmitted this container to the one device for vertical transport.

The object of the invention is to provide an installation of the type mentioned in which said disadvantage is obviated. This object is achieved in that in the transhipment installation according to the invention the device for the horizontal transport consists of a substantially horizontally extending continuous conveyor affording space for at least one container and extending from a point near one of the hoisting devices to a point near the other hoisting device.

The conveyor may be provided on a set of horizontal arms disposed at a small distance under the horizontal girder, in which case these arms may be mounted inside the frame.

Conveniently the conveyor may be mounted for movement over these horizontal arms so as each time the most favourable position for the conveyor can be obtained.

Preferably the conveyor consists of a chain conveyor which may comprise two pairs of chains in which between the chains of each pair, a plurality of spaced apart rods and extending at right angles to the chains are disposed, which rods are provided with bearing surfaces so that containers of various dimensions may be received.

Figure 2:
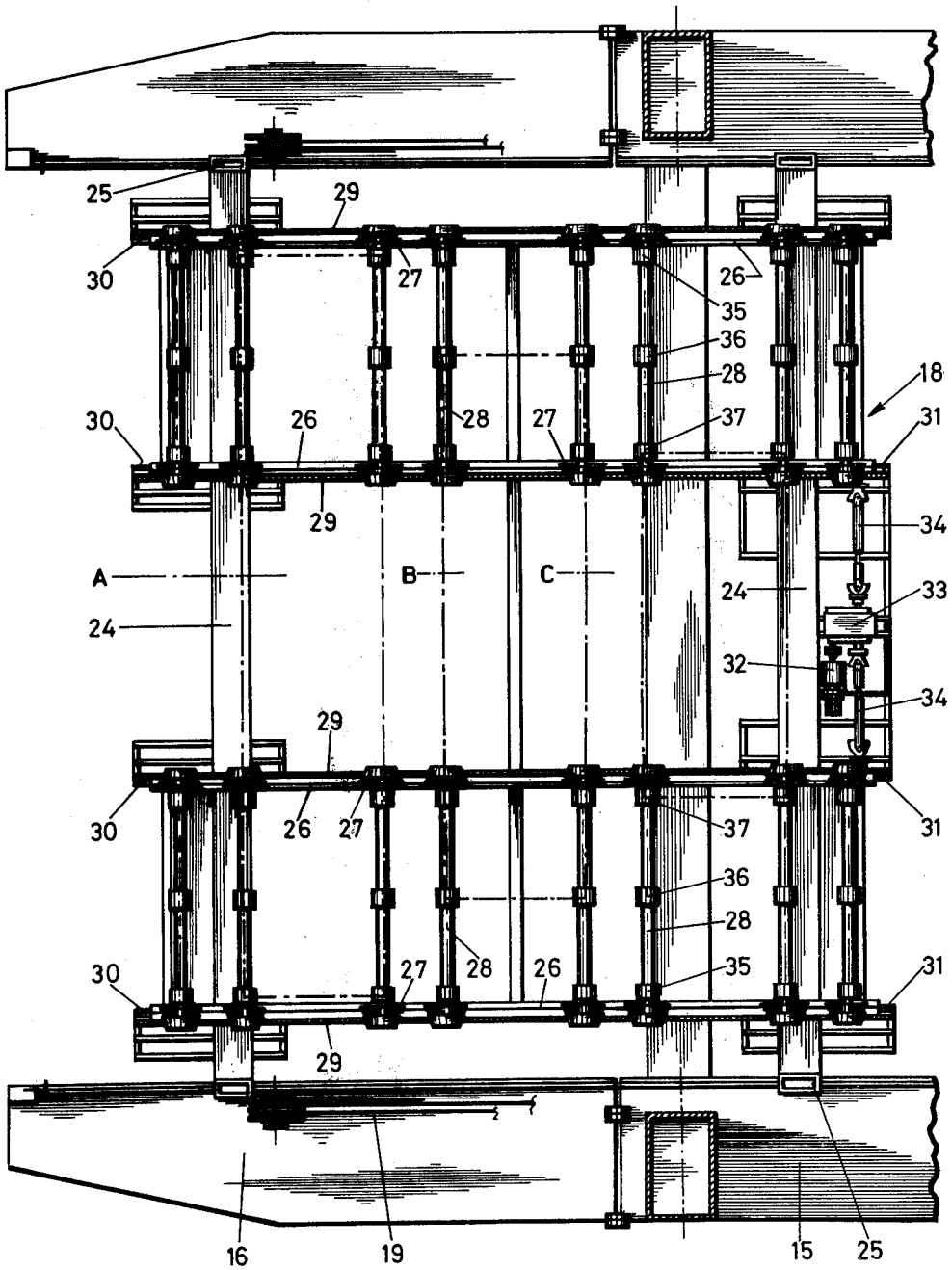

The invention will now be described in more detail for an embodiment of the invention with reference to the accompanying drawing, in which:

FIG. 1 is a side elevation of a transhipment installation according to the invention, and FIG. 2 is a top view at a larger scale of the conveyor in the transhipment installation.

The transhipment installation as shown in FIG. 1 consists of a frame indicated in its entirety by 1 which supports a horizontal girder 2 consisting of two parts 3 and 4, interconnected for a pivotal movement, so that part 3 may be swung upwardly by means of the cables 5. On the girder 2, two hoisting devices 6 and 7, formed as travelling hoists, are provided which are movable over the entire girder. Each travelling hoist 6 and 7 is provided with a operator's cabin 8 and 9 respectively and with hoisting means with hoisting cables 10 and 11 from which spreaders 12 and 13 are suspended for holding a container 14.

Each half of the frame 1 has a transverse girder 15, which is extended on both sides by the arms 16 and 17 so as to form a supporting beam, consisting of three parts 15, 16 and 17, for the conveyor indicated in its entirety by 18. The arm 16 is pivotally connected with the beam 15 and may be raised by means of the cables 19.

Further, the figure shows a motor housing 20 in which the winches for the positioning of the travelling hoists 6 and 7 and for raising the parts 3 and 16 are accomodated; the travelling wheels 21 with the aid of which the entire installation can be displaced over the quay 22 and, in outline, a container ship 23 with a plurality of cells and containers placed therein.

The conveyor 18 (see FIG. 2) comprises a frame member 24, mounted for movement over the transverse girders 15, 16 and 17 by the wheels 25. On this frame 24, two pairs of guiding members 26 are mounted, along which rollers 27 are guided which are mounted on both sides of a plurality of rods 28, the rollers 27 being interconnected by endless chains 29 passing over the chain wheels 30 and 31, the chain wheels 31 being driven by a motor 32 through the transmission 33 and the shafts 34. On each of the rods 28 three bearing surfaces 35, 36 and 37 are mounted, through which the conveyor may receive containers of three different dimensions A, B and C, indicated in FIG. 2 by dot-and-dash lines. The angular points of the container A rest upon the outermost bearing surfaces 35, those of the container B upon the intermediate bearing surfaces 36 and those of the container C on the innermost bearing surfaces 37.

When the transhipment installation according to the invention as shown in FIG. 1 is in operation, the raisable part 3 of the girder 2 is positioned over a container ship 23 so that the travelling hoist 6 can be positioned over one of the container cells of the container ship 23. With the aid of the hoisting cables 10 and the spreader 12, the containers 14 are now lifted one by one from the ship and then placed upon the conveyor 18. After a container 14 has been placed upon the conveyor, this container is moved to the right in FIG. 1 by the conveyor, after which the travelling hoist 7 can take this container from the conveyor by means of the hoisting cables 11 and the spreader 13 and subsequently lower it to a transport system present on the quay 22, e.g. a truck. It will be appreciated that these steps may also be carried out in a reverse order for the loading of a container ship. In the arrangement as shown in FIG. 1, the conveyor 18 is adapted for receiving several containers so that the conveyor will serve likewise as a means for temporary storage of the containers, so that if a delay should occur in the transport system on the quay, preventing the proceeding of the vertical transport system 7, 11, 13 or a delay in this vertical transport system itself, the vertical transport system 6, 10, 12 can continue its operation. Consequently, the vertical transport systems 6, 10, 12 and 7, 11, 13 may function simultaneously and independently of each other.

Thus the conveyor 18 does not merely serve for the horizontal transport, this transport being continuous but also as a buffer between the vertical transport devices. Because of the conveyor itself being movable in its entirety over the beam 15, 16, 17, it may be positioned in the most favourable position with respect to the container cells in the ship and/or the transport system present on the quayside, while it will also be possible to move the conveyor as much as possible to the right in FIG. 1, as a result of which the spreader 12 may likewise reach the quay 22 directly without meeting any obstacle.

Changes and modifications may be made within the scope of the invention. Thus, for instance, the conveyor 18 may be arranged in such a manner that it may be positioned underneath one of the two vertical transport systems, in which case the containers are lifted or lowered between the pairs of chains of the conveyor, for which purpose the vertical transport systems should be provided with means to turn the containers over 90°.

I claim:

1. A container loading and unloading device wherein containers are raised along a substantially vertical path, thereafter displaced along a horizontal path and finally lowered along a vertical path, said device comprising:

a first horizontal girder supported by a frame at a predetermined elevation above a floor;

at least two hoists disposed for raising and lowering of the containers, said hoists being supported by and movable over said girder and operatively positioned a distance from each other;

a second horizontal girder supported by the frame beneath said first girder;

a set of horizontal parallel arms extending beyond the frame and pivotally connected to said second horizontal girder such that the arms can be moved with respect to said second horizontal girder, means for raising and lowering said arms; and at least one substantially horizontally extending continuous conveyor for the horizontal displacement of the containers, said conveyor being mounted on said parallel arms for movement thereon between said hoists, said conveyor including a support for at least one container and means for displacing said support and container placed thereon along a horizontal path from a point near one hoist to a point near the other hoist.

2. The device of claim 1, wherein said conveyor is a chain conveyor.

3. The device of claim 2, wherein said chain conveyor comprises two pairs of chains and a plurality of spaced apart rods between each pair of chains, said rods extending at right angles to said chains, said rods being provided with bearing surfaces.

4. The device of claim 1, wherein the means for raising and lowering said parallel arms are cables attached separately to each of said arms.

5. The device of claim 4, wherein said conveyor comprises:

a frame having wheels secured thereon for rolling engagement with guide tracks carried on said parallel arms;

a pair of guiding members carried by said frame inside said parallel arms;

a plurality of rods extending transversely to said guide members, said rods having a bearing surface theron for receiving containers of more than one size;

a plurality of rollers mounted on both ends of said rods, said rollers being guided along said guiding members and interconnected by an endless chain; and chain drive wheels engaging said endless chain and being driven by a motor.

* * * * *